US010619275B2

(12) United States Patent
Chen et al.

(10) Patent No.: US 10,619,275 B2
(45) Date of Patent: Apr. 14, 2020

(54) THERMALLY STABLE NONWOVEN WEB COMPRISING MELTBLOWN BLENDED-POLYMER FIBERS

(71) Applicants: 3M INNOVATIVE PROPERTIES COMPANY, St. Paul, MN (US); Rui Chen, Shanghai (CN)

(72) Inventors: Rui Chen, Shanghai (CN); Xiaoshuan Fu, Shanghai (CN); Jin Zhang You, Shanghai (CN); Chiaki Hanamaki, Kanagawa (JP); Sachin Talwar, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 257 days.

(21) Appl. No.: 15/318,613

(22) PCT Filed: Jun. 26, 2014

(86) PCT No.: PCT/CN2014/080901
§ 371 (c)(1),
(2) Date: Dec. 13, 2016

(87) PCT Pub. No.: WO2015/196438
PCT Pub. Date: Dec. 30, 2015

(65) Prior Publication Data
US 2017/0130379 A1 May 11, 2017

(51) Int. Cl.

| | |
|---|---|
| ***D04H 5/06*** | (2006.01) |
| ***D01F 6/92*** | (2006.01) |
| ***D04H 1/56*** | (2006.01) |
| ***D04H 1/435*** | (2012.01) |
| ***D01D 5/098*** | (2006.01) |

(52) U.S. Cl.
CPC ..... *D04H 5/06* (2013.01); *D01D 5/0985* (2013.01); *D01F 6/92* (2013.01); *D04H 1/435* (2013.01); *D04H 1/56* (2013.01)

(58) Field of Classification Search
CPC ..... D01D 5/0985; D01F 6/92; D04H 1/435; D04H 1/56; D04H 5/06
See application file for complete search history.

(56) References Cited

U.S. PATENT DOCUMENTS

| | | | |
|---|---|---|---|
| 4,118,531 | A | 10/1978 | Hauser |
| 4,370,438 | A | 1/1983 | DeGuia |
| 5,207,970 | A | 5/1993 | Joseph |

(Continued)

FOREIGN PATENT DOCUMENTS

| | | |
|---|---|---|
| CN | 1920149 | 2/2007 |
| CN | 101857985 | 10/2010 |

(Continued)

OTHER PUBLICATIONS

Bhat et al., "Conversion of Recycled Polymers/Fibers into Melt Blown Nonwovens", Jan. 1, 1999, 22 pages, URL:https://www.academia.edu/15079133/Conversion_of_Recycled_Polymers_Fibers_Into_Melt-Blown_Nonwovens.

(Continued)

*Primary Examiner* — Arti Singh-Pandey
(74) *Attorney, Agent, or Firm* — Kenneth B. Wood

(57) ABSTRACT

A thermally stable nonwoven web including blended-polymer meltblown fibers containing a blend of poly (butylene terephthalate) and poly (ethylene terephthalate).

14 Claims, 1 Drawing Sheet

(56) References Cited

U.S. PATENT DOCUMENTS

| | | | | |
|---|---|---|---|---|
| 5,232,770 | A | 8/1993 | Joseph | |
| 5,364,694 | A | 11/1994 | Okada | |
| 5,439,438 | A | 8/1995 | Ersfeld | |
| 5,480,466 | A | 1/1996 | Jackson | |
| 6,057,256 | A | 5/2000 | Krueger | |
| 7,476,632 | B2 | 1/2009 | Olson | |
| 7,989,371 | B2 | 8/2011 | Angadjivand | |
| 2002/0037679 | A1 | 3/2002 | Bansal | |
| 2008/0160861 | A1 | 7/2008 | Berrigan et al. | |
| 2008/0315454 | A1 | 12/2008 | Angadjivand et al. | |
| 2015/0125696 | A1* | 5/2015 | Fedorova | D04H 3/16 428/401 |
| 2016/0101590 | A1 | 4/2016 | Kane et al. | |

FOREIGN PATENT DOCUMENTS

| | | | |
|---|---|---|---|
| CN | 101994213 | | 3/2011 |
| CN | 102439210 | | 5/2012 |
| EP | 0 33 228 | A2 | 9/1989 |
| JP | 4-185738 | | 7/1992 |
| JP | 8-3430 | | 1/1996 |
| JP | 8-283549 | | 10/1996 |
| JP | 9-314688 | | 12/1997 |
| JP | 2000-44780 | | 2/2000 |
| JP | 2002-69824 | | 3/2002 |
| JP | 2005-75903 | | 3/2005 |
| JP | 2005-194331 | | 7/2005 |
| JP | 2005-298595 | | 10/2005 |
| JP | 5047848 | | 10/2012 |
| WO | WO 2002-29145 | | 4/2002 |
| WO | WO 2007-089747 | | 8/2007 |
| WO | WO 2010-117612 | | 10/2010 |
| WO | WO 2012-051479 | | 4/2012 |

OTHER PUBLICATIONS

Extended European Search Report, EP14896221.0, dated Dec. 6, 2017, 3 pages.

Wente, "Manufacture of Superfine Organic Fibers", May 25, 1954, 18 pages.

Wente, "Superfine Thermoplastic Fibers", Industrial Engineering Chemistry, Aug. 1956, vol. 48, No. 8, pp. 1342-1346.

Zhang, "The research Character of PBT/PET Blend Fiber", May 25, 2006, pp. 8-10.

International Search Report for PCT International Application No. PCT/CN2014/080901 dated Mar. 30, 2015, 5 pages.

* cited by examiner

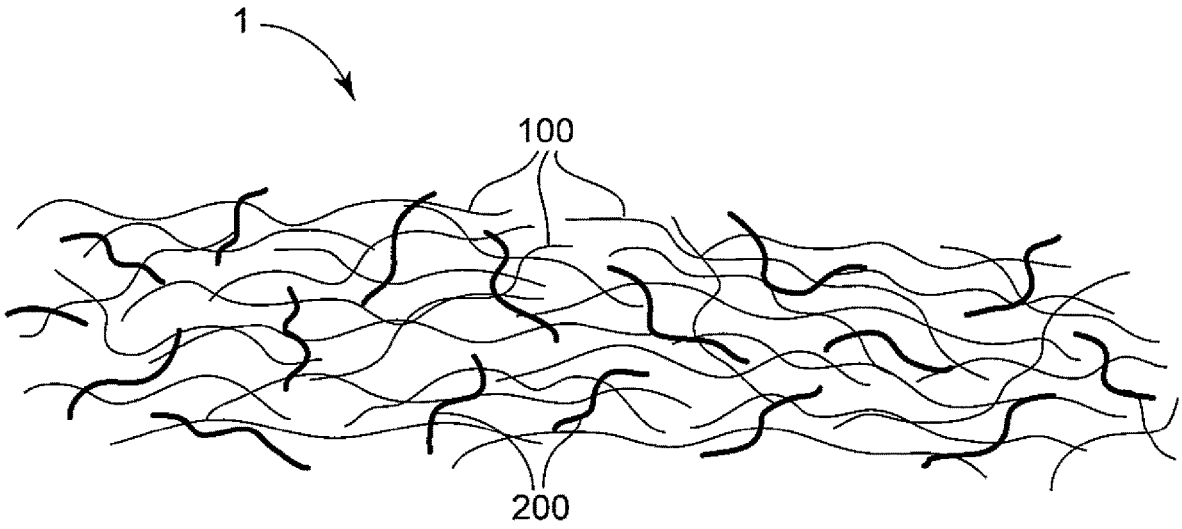
1
100
200

THERMALLY STABLE NONWOVEN WEB COMPRISING MELTBLOWN BLENDED-POLYMER FIBERS

BACKGROUND

Meltblowing is a process for forming nonwoven fibrous webs of thermoplastic polymeric fibers. In a typical meltblowing process, one or more molten polymer streams are extruded through die orifices and attenuated by convergent streams of high-velocity air ("blowing" air) to form fibers that are collected to form a meltblown nonwoven fibrous web. Meltblown nonwoven fibrous webs are used in a variety of applications, including acoustic and thermal insulation, filtration media, surgical drapes, and wipes, among others.

SUMMARY

In broad summary, herein is disclosed a thermally stable nonwoven web, comprising blended-polymer meltblown fibers comprising a blend of poly(butylene terephthalate) and poly(ethylene terephthalate). These and other aspects will be apparent from the detailed description below. In no event, however, should this broad summary be construed to limit the claimable subject matter, whether such subject matter is presented in claims in the application as initially filed or in claims that are amended or otherwise presented in prosecution.

BRIEF DESCRIPTION OF THE DRAWING

The FIGURE is a side schematic cross-sectional view of a portion of an exemplary thermally stable nonwoven web as disclosed herein.

The FIGURE is not to scale and is chosen for the purpose of illustrating different embodiments of the invention. In particular the dimensions of the various components are depicted in illustrative terms only, and no relationship between the dimensions of the various components should be inferred from the FIGURE. Some elements may be present in multiples; in such cases only one or more representative elements may be designated by a reference number but it will be understood that such reference numbers apply to all such elements. Although terms such as "top", bottom", "upper", lower", "under", "over", "front", "back", "outward", "inward", "up" and "down", and "first" and "second" may be used in this disclosure, it should be understood that those terms are used in their relative sense only unless otherwise noted.

As used herein as a modifier to a property or attribute, the term "generally", unless otherwise specifically defined, means that the property or attribute would be readily recognizable by a person of ordinary skill but without requiring absolute precision or a perfect match (e.g., within +/−20% for quantifiable properties). The term "substantially", unless otherwise specifically defined, means to a high degree of approximation (e.g., within +/−10% for quantifiable properties) but again without requiring absolute precision or a perfect match. Terms such as same, equal, uniform, constant, strictly, and the like, are understood to be within the usual tolerances or measuring error applicable to the particular circumstance rather than requiring absolute precision or a perfect match. Those of ordinary skill will appreciate that as used herein, terms such as "substantially no", "substantially free of", and the like, do not preclude the presence of some extremely low, e.g. 0.1% or less, amount of material, as may occur e.g. when using large scale production equipment subject to customary cleaning procedures.

Glossary

By a thermally stable web is meant a web exhibiting less than 10% thermal shrink when tested as described in the Examples herein.

By staple fibers are meant fibers that are cut or chopped to a predetermined length and are incorporated into a nonwoven web in solid form.

By meltblown fibers/webs are meant fibers/webs prepared by meltblowing.

By meltblowing is meant extruding molten fiber-forming material through a plurality of orifices of a die to provide molten filaments. The filaments, essentially immediately after exiting the orifices, are contacted with high-velocity streams of gas (e.g., air) to attenuate the filaments into (meltblown) fibers, which are then collected, as described in detail later herein.

By "filaments" are meant molten streams of thermoplastic material that are extruded from a set of orifices; by fibers is meant solidified filaments. By web is meant a mass of collected fibers, at least some of which have been bonded to each other to a sufficient extent that web has sufficient mechanical integrity to be handled with conventional roll-to-roll equipment.

By $T_m$ is meant the crystalline melting point of a semicrystalline polymer, measured as described in the Examples herein.

By polymer is meant a material made of macromolecules having a number-average molecular weight of at least about 10,000. The term polymer is used for convenience of description and specifically encompasses copolymers, and also allows the presence of non-polymeric additives (as are often present in e.g. thermoplastic polymers for various purposes), unless otherwise indicated.

By non-polymeric means having a number-average molecular weight of below 10000.

DETAILED DESCRIPTION

Herein is disclosed a thermally stable nonwoven fibrous web 1, as shown in exemplary embodiment in the FIGURE. Web 1 comprises a plurality of meltblown fibers 100, which meltblown fibers include at least some blended-polymer fibers as discussed below in detail. Web 1 further includes at least some staple fibers 200, as discussed later herein in detail.

Meltblown fibers 100 include at least some blended-polymer fibers. By a blended-polymer fiber is meant a fiber comprising at least two separate polymers, which are processed (e.g., inserted as pellets) in a common extruder and are thus melt-blended to form a polymer blend. Flowstreams of the polymer blend are extruded through numerous meltblowing orifices to form molten blended-polymer filaments, which are attenuated to form meltblown blended-polymer fibers. In such fibers, the (solidified) macromolecules of the polymers may exhibit a variety of microstructures, depending e.g. on the ratio of the polymers used and the processing conditions. For example, one polymer may be present as minute parcels (e.g., islands, globules, etc.) dispersed throughout a continuous phase of the other polymer. Or, both polymers may be present as continuous or quasi-continuous phases (e.g. as interpenetrating networks). Or, e.g. if the polymers are at least partially miscible (and also depending on process conditions, e.g. the extruder temperature and the residence time in the extruder and die during which mixing can occur) at least some portions of the polymers may be mixed (intermingled) at the macromolecular level. Typically, the overall composition of the blended-polymer fibers will be at least generally uniform, often substantially uniform, down the length of the fibers.

Regardless of the specific microstructure found in a given meltblown blended-polymer fiber, the term blended-polymer fiber by definition specifically excludes multilayer fibers and sheath-core fibers. The ordinary artisan will understand that even though blended-polymer fibers may occasionally exhibit one polymer phase that extends along the long axis of the fiber to some extent, such unstable and unpredictable occurrences cannot be equated with a predetermined, multilayer fiber.

Meltblown blended-polymer fibers 100 are comprised of at least poly(butylene terephthalate) (PBT), which is a fast-crystallizing polymer, and poly(ethylene terephthalate) (PET), which is a slow-crystallizing polymer. By a fast-crystallizing polymer is meant a polymer that, under the relatively rapid cooling conditions employed in conventional meltblowing processes, forms crystalline domains at a rate sufficiently fast that the solidified meltblown fibers display a degree of crystallization that is generally similar to the value that would be exhibited if the polymer were subjected to a slower cooling process. In contrast, by a slow-crystallizing polymer is meant a polymer that, under the cooling conditions employed in conventional meltblowing processes, forms crystalline domains at a rate that is sufficiently slow that the solidified meltblown fibers display a degree of crystallization that is significantly below the value that would be exhibited if the polymer were subjected to a slower cooling process.

The PBT and the PET may be present at a weight ratio of from about 80:20 (PBT:PET) to about 30:70 in the meltblown fibers, calculated based on the total weight of PBT and PET in the meltblown fibers of the web, including any polymer of either type that may be present in monocomponent meltblown fibers that are present in addition to the blended-polymer fibers, but not including any PBT or PET that might be present in staple fibers. In various embodiments, the weight ratio of PBT to PET way be at most about 75:25, 70:30, 65:35, 60:40, 50:50, 40:60, or 35:65. In further embodiments, the weight ratio of PBT to PET may be at least about 35:65, 40:60, 50:50, 60:40, 65:35, 70:30, or 75:25. In some embodiments, PBT and PET may be substantially the only polymers present in meltblown blended-polymer fibers 100.

The arrangements disclosed herein can allow a significant amount of the PBT to be replaced by PET, while preserving advantageous properties (e.g., a low level of thermal shrink) that might be expected to only be imparted by high levels of PBT (e.g. by nonwoven webs consisting of monocomponent PBT fibers), as evidenced in the Working Examples. Specifically, it appears the presence of fast-crystallizing PBT seems able to significantly accelerate the crystallization of (otherwise slow-crystallizing) PET, even under such conditions of relatively rapid cooling as prevail in meltblowing. This can provide that the thus-formed nonwoven web exhibits thermal shrinkage more similar to that exhibited by a monocomponent PBT web than to that exhibited by a monocomponent PET web. A significant portion of the PBT can thus be replaced by PET while maintaining satisfactory properties, which can provide significant benefits since PBT is typically much more expensive than PET.

The average diameter of the meltblown fibers (measured e.g. by optical microscopy, using a sampling of representative fibers) may be in any desired range. It will be appreciated that meltblowing (because of e.g. the tendency of the high-velocity "blowing" air to reduce the diameter of the molten filaments), is particularly well-suited for the formation of so-called microfibers (meaning fibers with an average diameter of 10 microns or less). Thus, in various embodiments, the average diameter of the meltblown fibers may be less than about 30, 20, 15, 10, 5, 2, or 1 microns. In further embodiments, the average diameter of the meltblown fibers may be at least about 0.5, 1, 2, or 5 microns.

In at least some embodiments, web 1 additionally includes staple fibers 200, as shown in exemplary embodiment in the FIGURE. In web 1, staple fibers 200 are distributed throughout, and intermingled within, the network of meltblown fibers. In various embodiments, staple fibers 200 may make up at least about 5, 10, 20, 30, 40, or 50 wt. % of the total weight of the fibrous material (e.g. meltblown fibers plus staple fibers) of the web. In further embodiments, staple fibers 200 may make up at most about 60, 50, 40, 30, or 20 wt. % of the total weight of the fibrous material of the web.

Regardless of their particular process of manufacture or composition, staple fibers are typically machine cut to a specific predetermined or identifiable length and are added to a nonwoven web in solidified form. The length of the staple fibers often much less than that of meltblown fibers; and, in various embodiments, may be from about 1 to 8 cm or from about 2.5 cm to 6 cm. The average fiber diameter for the staple fibers is often greater than about 15 μm on average, and in various embodiments can be greater than 20, 30, 40, or 50 μm. Thus, in many embodiments the average fiber diameter of the staple fibers may be at least about 2, 4, or 8 times the average diameter of the meltblown blended-polymer fibers. The staple fibers may be crimped fibers e.g. like the fibers described in U.S. Pat. No. 4,118,531 to Hauser. Crimped fibers may have a continuous wavy, curly, or jagged profile along their length. The staple fibers may comprise crimped fibers that comprise e.g. about 10 to 30 crimps per cm. The staple fibers may be single component fibers or multicomponent fibers.

In some embodiments, the staple fibers may include synthetic polymeric materials. In some embodiments, the staple fibers may include natural fibers (chosen from fibers derived from e.g. bamboo, cotton, wool, jute, agave, sisal, coconut, soybean, hemp, and the like). If desired, the composition of at least some of the staple fibers may be chosen so that they can be meltbonded to each other and/or to the meltblown fibers during a molding process (such as might be used to form a shaped article that includes the nonwoven web). Alternatively, they can be made of materials with properties (e.g. melting point) such that they do not bond to each other or to the meltblown fibers during a molding process.

Suitable staple fibers may be prepared e.g. from any suitable polyester and copolymers thereof, polyolefin such as e.g. polyethylene, polypropylene and copolymers thereof, polysulfonamide, polyamide, or combinations of any of these. In specific embodiments, the staple fibers are PET fibers, which are advantageously inexpensive and widely available. As shown in the Working Examples herein, the inclusion of staple fibers in a nonwoven web comprising meltblown PBT:PET blended-polymer fibers has been found to not increase the thermal shrink, and in some cases to even advantageously decrease the thermal shrink, even when the staple fibers are PET fibers that increase the weight ratio of PET to PBT in the web as a whole.

Various other components may be present in web 1 and in particular in meltblown blended-polymer fibers 100, as desired for various purposes. For example, any desired type of particulate additive may be present in web 1. In particular, if web 1 is used for filtration purposes, any suitable sorbent, catalytic, chemically reactive, etc. particulate additive may be present. Meltblown blended-polymer fibers 100, in particular, may have any suitable ancillary components present therein. Such components may be present e.g. in the above-described PBT and/or the PET as obtained, and may include e.g. processing additives, antioxidants, UV stabilizers, fire-retardant additives, and so on. In some embodiments, the PET and/or the PBT may include one or more non-polymeric nucleating agents (e.g., melt additives), which may be chosen from e.g. various stearates, carboxylic acid salts, nitrogen-containing heteroaromatic compounds, and so on. However, in particular embodiments, the PET and the PBT each include less than about 5, 2, 1, or 0.5 wt. % of any non-polymeric nucleating agent. In specific embodiments, both the PET and the PBT are substantially free of any non-polymeric nucleating agent.

In some further embodiments, web 1 may comprise at least some amount of polymeric nucleating agent, which might be added e.g. as a melt additive with the PBT and/or the PET. Such materials might include e.g. polyester-sulfonate salts, certain polyolefins such as polypropylene, polyethylene, and copolymers and blends thereof. Such materials may nevertheless provide benefits, as long as they are not present in such quantity as to unacceptably affect e.g. the thermal shrinkage of the resulting web. Thus, in various embodiments, meltblown blended-polymer fibers 100 may comprise up to, and no more than, about 5, 2, 1, or 0.5 wt. % of any polymeric nucleating agent. In specific embodiments, meltblown fibers 100 are substantially free of any polymeric nucleating agent.

In some embodiments it may be advantageous to minimize the amount of polymer that exhibits a $T_m$ of less than 200° C. in the nonwoven web. (In this context, the term polymer that exhibits a $T_m$ of less than 200° C. specifically includes not merely homopolymer chains of the polymer, but any segments of such material that may be present in a copolymer macromolecules.) Thus, in various embodiments, any polymer with a $T_m$ of less than 200° C., is present at less than about 20, 10, 5, 2, 1, or 0.5 wt. % based on the total fibrous material of the web (including e.g. staple fibers). In further embodiments, the nonwoven web is substantially free of polymeric material with a $T_m$ of less than 200° C. It may be useful in some embodiments to minimize the amount of polymer that exhibits a $T_m$ of less than 200° C., in particular in the meltblown fibers of the web. Thus, in various embodiments, any polymer with a $T_m$ of less than 200° C., is present in the meltblown fibers of the web (including any non-blended-polymer meltblown fibers) at less than about 20, 10, 5, 2, 1, or 0.5 wt. %. In further embodiments, the meltblown fibers of the web are substantially free of polymer with a $T_m$ of less than 200° C.

In various embodiments, web 1 as disclosed herein may exhibit a thermal shrink (measured as disclosed in the Examples herein) of less than about 10, 8, 6, 5, 4, 2, or 1%. As discussed herein, such a property may provide significant advantages in certain applications.

As noted, the herein-disclosed nonwoven webs employ meltblown fibers, as defined above. The ordinary artisan will understand that a meltblowing process, and meltblown fibers and a meltblown nonwoven web formed by such a process, are distinguished from e.g. processes such as meltspinning and from the resulting products such as meltspun fibers and meltspun (e.g., spunbonded) nonwoven webs. The terms meltspinning and meltspun are terms of the art that refer to forming fibers by extruding molten filaments out of a set of orifices and allowing the filaments to cool and solidify to form fibers, with the filaments passing through an air space (which may contain streams of moving air) to assist in cooling the filaments. The cooled filaments are then passed through a drawing unit to at least partially draw the filaments (so as to e.g. induce orientation and enhanced physical properties). Meltspinning can thus be distinguished from meltblowing in that meltblowing involves the extrusion of molten filaments into converging high velocity air streams introduced by way of air-blowing openings located in close proximity to the extrusion orifices. The ordinary artisan will understand that meltblowing and meltspinning thus impart different characteristics (of e.g., molecular orientation and resulting physical properties) to the resulting fibers and webs (even if the fibers/webs are of like composition) and will thus appreciate that meltblown fibers and meltspun fibers can be readily distinguished from each other.

Thus, the herein-described meltblown blended-polymer fibers may be produced by the use of a meltblowing die capable of emitting molten blended-polymer filaments therefrom, a device for impinging high velocity "blowing" air on the molten filaments essentially immediately after they leave the orifices of the meltblowing die (e.g., within about a centimeter of exiting the orifices of the meltblowing die) so as to attenuate the filaments into meltblown fibers, a collector for collecting the meltblown fibers, and various ancillary equipment (e.g. extruders, temperature control equipment, and so on) as are customarily used in meltblowing. In particular, the raw materials (e.g. pellets) of PET and PBT may be dispensed into a common extruder so that they may be melted and mixed with each other, then delivered to the meltblowing die. Such an apparatus may be of the general type taught, for example, in van Wente, "Superfine Thermoplastic Fibers", *Industrial Engineering Chemistry*, Vol. 48, pages 1342 et sec (1956), or in Report No. 4364 of the Naval Research Laboratories, published May 25, 1954 entitled "Manufacture of Superfine Organic Fibers" by van Wente, A., Boone, C. D., and Fluharty, E. L.

It has been found that certain process conditions, specifically, the temperature of the high velocity "blowing" air is impinged on the molten filaments as they emerged from the orifices of the melt-blowing die, can be manipulated to further enhance the performance of the nonwoven webs produced thereby. Specifically, it has been found that the thermal shrink may be advantageously reduced as the nominal temperature of the blowing air is increased from e.g. about 340-350° C. up to about 400° C. (The term nominal temperature is used herein to acknowledge that this temperature is a set-point temperature and that the high-velocity air, at the point of actual impingement on the moving molten filaments, might differ slightly from the nominal setpoint, as will be well understood by the ordinary artisan). Thus in various embodiments, the meltblowing apparatus may be operated with the nominal set-point of the blowing air being at least about 340, 350, 360, 380, or 400° C.

In some embodiments, the meltblown fibers may be collected on a flat surface (e.g., a porous collecting belt or netting) or on the surface of a single collecting drum. In other embodiments, the meltblown fibers may be collected in a gap between converging collecting surfaces, e.g. between first and second collecting drums. Such arrangements may provide that the meltblown fibers 100 are present in web 1 at least generally, or substantially, in a "C"-shaped cross-sectional configuration. Such arrangements (which are described in detail in U.S. Pat. No. 7,476,632 to Olson, which is incorporated by reference in its entirety herein), may provide e.g. increased loft and/or other beneficial properties.

In at least some embodiments, staple fibers may be incorporated into nonwoven web 1 as noted above. This may be performed e.g. by injecting an airborne stream of staple fibers into the airborne stream of attenuated filaments/fibers. (Since the process in which the molten filaments solidify to form fibers during their flight from the die orifices to the collector will be a statistical process, the terms filaments and fibers are somewhat interchangeable at this stage of the process.) This can form an intermingled airstream of meltblown blended-polymer fibers, and staple fibers, which airstream can be impinged on a collector to collect the intermingled blended-polymer meltblown fibers and staple fibers as a mass of fibers. Apparatus and processes for injecting staple fibers into a stream of e.g. meltblown fibers are described in further detail in e.g. U.S. Pat. No. 7,989,371 to Angadjivand and in U.S. Pat. No. 4,118,531 to Hauser.

In some embodiments, at least some staple fibers may function as bonding fibers, as noted earlier. Alternatively, or as an adjunct to this, at least some of the meltblown fibers may (e.g., depending on the manner of collection and so on) be bonded, e.g. melt-bonded, to each other. If desired, any suitable post-bonding process might be used (e.g., point-bonding via a calendering operation, etc.).

Although the discussions above have disclosed the incorporation of staple fibers (of e.g. PET) into a nonwoven web comprising meltblown blended-polymer fibers, it is noted that in some embodiments (e.g. at a sufficiently high ratio of PBT to PET in the meltblown blended-polymer fibers), performance that is satisfactory for at least some applications (e.g., thermal shrink of below about 10%) may be obtained at low levels of staple fiber or even in the absence of staple fibers. Thus, as evidenced in Examples 4 and 5, nonwoven webs comprising blended-polymer meltblown fibers at a PBT:PET ratio of at least about 45:55 can provide satisfactorily low thermal shrinkage in the absence of staple fibers. Thus, in various embodiments, disclosed herein is a thermally stable nonwoven web comprising meltblown fibers, in which at least selected meltblown fibers are blended-polymer fibers each comprising a blend of poly (butylene terephthalate) (PBT) and poly(ethylene terephthalate) (PET), wherein the meltblown fibers exhibit an average weight ratio of PBT to PET of from about 40:60 to about 80:20. In various embodiments, meltblown fibers of such a web may exhibit an average weight ratio of PBT To PET of from about 45:55 to 70:30, or from about 50:50 to about 65:35. In further embodiments, such a web may include less than about 20, 10, 5, 2, 1, or 0.5 wt. % staple fibers (based on the total fibrous materials of the web). In specific embodiments, such a web may be substantially free of staple fibers. In certain embodiments, such a web may be a single-layer meltblown web that does not have any other layers (e.g., other nonwoven webs such as a spunbonded web or scrim) laminated thereto.

The meltblown fibrous webs described herein can be incorporated (e.g., as a web, sheet, scrim, fabric, etc., of any suitable thickness, dimension, etc.) into articles such as thermal and acoustic insulating articles, liquid and gas filters made, and so on. Although any suitable use is envisioned, the resistance to thermal shrinkage of the meltblown web may render such articles particularly suitable for use in relatively high temperature environments. Such articles may find use in a wide variety of applications, e.g. acoustic and/or insulation of vehicles or of architectural components, in personal protective devices or clothing, and so on. Such meltblown webs may be particularly useful in thermal insulation articles and/or high temperature acoustical insulation articles, noting that in some uses (e.g., in automotive hoodliners), such an article may perform both functions. Meltblown fibrous web 1 may be combined with any desired additional layer (e.g., scrim, facing, and so on), as may be advantageous in forming a particular article. Web 1, along with any such additional layers, may be processed (e.g., shaped, cut, and so on) to form an article of a particular configuration.

LIST OF EXEMPLARY EMBODIMENTS

Embodiment 1 is a thermally stable nonwoven web, comprising: meltblown fibers, wherein at least selected meltblown fibers are blended-polymer fibers each comprising a blend of poly(butylene terephthalate) (PBT) and poly (ethylene terephthalate) (PET) and wherein the meltblown fibers exhibit an average weight ratio of PBT to PET of from about 80:20 to about 30:70; and, staple fibers, wherein the staple fibers make up from about 10 wt. % to about 60 wt. % of the total weight of the fibrous material of the web; and wherein the thermally stable nonwoven web exhibits a thermal shrink of less than about 10%.

Embodiment 2 is the web of embodiment 1, wherein the meltblown fibers exhibit an average weight ratio of PBT to PET of from about 70:30 to about 35:65. Embodiment 3 is the web of any of embodiments 1-2, wherein the PET is substantially free of non-polymeric nucleating agent. Embodiment 4 is the web of any of embodiments 1-3, wherein the meltblown fibers collectively exhibit an average fiber diameter of less than about 10 micrometers.

Embodiment 5 is the web any of embodiments 1-4, wherein the staple fibers make up from about 20 wt. % to about 60 wt. % of the total weight of the fibrous material of the web. Embodiment 6 is the web of any of embodiments 1-5, wherein the staple fibers make up from about 30 wt. % to about 60 wt. % of the total weight of the fibrous material of the web. Embodiment 7 is the web of any of embodiments 1-6, wherein the staple fibers make up from about 40 wt. % to about 60 wt. % of the total weight of the fibrous material of the web. Embodiment 8 is the web of any of embodiments 1-7, wherein the staple fibers are PET fibers.

Embodiment 9 is the web of any of embodiments 1-8, wherein the web exhibits a thermal shrink of less than about 6%. Embodiment 10 is the web of any of embodiments 1-9, wherein the web exhibits a thermal shrink of less than about 4%. Embodiment 11 is the web of any of embodiments 1-10, wherein the web exhibits a thermal shrink of less than about 2%.

Embodiment 12 is the web of any of embodiments 1-11, wherein the meltblown fibers collectively comprise no more than about 5 wt. % of any polymeric material that exhibits a $T_m$ of less than 200° C. Embodiment 13 is the web of any of embodiments 1-12, wherein the meltblown fibers are substantially free of any polymeric material with a $T_m$ of less than 200° C.

Embodiment 14 is an article comprising the thermally stable nonwoven web of any of embodiments 1-13, wherein the article is selected from the group consisting of a thermal insulation article, an acoustic insulation article, a fluid filtration article, or a combination thereof. Embodiment 15 is the article of embodiment 14, wherein the article is an acoustic insulation article that exhibits a thermal shrink of less than about 5%.

Embodiment 16 is a method comprising: extruding molten blended-polymer flowstreams through orifices of a meltblowing die to form molten blended-polymer filaments; attenuating the molten blended-polymer filaments with high-velocity gaseous streams to form an airborne stream of blended-polymer meltblown fibers; injecting an airborne stream of staple fibers into the airborne stream of blended-polymer meltblown fibers; and, collecting the intermingled meltblown blended-polymer fibers and staple fibers as a mass of fibers; wherein at least selected meltblown blended-polymer fibers each comprising a blend of poly(butylene terephthalate) (PBT) and polyethylene terephthalate) (PET), wherein the meltblown fibers exhibit an average weight ratio of PBT to PET of from about 80:20 to about 30:70, wherein the staple fibers make up from about 10 wt. % to about 60 wt. % of the total weight of the fibrous material of the web; and wherein the thermally stable nonwoven web exhibits a thermal shrink of less than about 10%.

Embodiment 17 is the method of embodiment 16 wherein the high-velocity gaseous streams are set at a nominal set-point of at least about 350° C. Embodiment 18 is the method of embodiment 16 wherein the high-velocity gaseous streams are set at a nominal set-point of at least about 390° C. Embodiment 19 is the method of any of embodiments 16-18 wherein the method further includes bonding at least some of the fibers of the mass of fibers to each other to form a thermally stable nonwoven web.

Embodiment 20 is a thermally stable nonwoven web comprising meltblown fibers, in which at least selected meltblown fibers are blended-polymer fibers each comprising a blend of poly(butylene terephthalate) (PBT) and poly (ethylene terephthalate) (PET), wherein the meltblown fibers exhibit an average weight ratio of PBT to PET of from about 40:60 to about 80:20.

EXAMPLES

Test Methods

Thermal Shrinkage

The thermal shrinkage meltblown webs can be obtained using five 10 cm by 10 cm samples taken from nonwoven webs. The dimension of each specimen (typically, in both the machine (MD) and cross direction (CD)) is measured before and after placement in a Fisher Scientific Isotemp Oven (or the equivalent) at 170° C. for 15 minutes. Shrinkage for each samples is calculated by the following equation:

$$\text{Shrinkage} = \left(\frac{L_o - L}{L_o}\right) \times 100\%$$

where $L_0$ is the initial specimen length and L is the final specimen length. Average values of shrinkage (typically, averaged over both MD and CD) are calculated and reported.

Apparatus and Methods of Making Meltblown Webs

Meltblown webs were prepared using an apparatus and process similar to that described in Wente, Van A., "Superfine Thermoplastic Fibers" in Industrial Engineering Chemistry, Vol. 48, pages 1342 et seq. (1956), and in Report No. 4364 of the Naval Research Laboratories, published May 25, 1954 entitled "Manufacture of Superfine Organic Fibers" by Wente, Van. A. Boone, C. D., and Fluharty, E. L. A 50 mm single-screw extruder was used, which was configured to feed (via a gear pump) the molten extrudate to a meltblowing die having circular smooth surfaced extrusion orifices (spaced at approximately a 1 mm center-to-center spacing in a single row comprising a total working width of approximately 50.8 cm). The individual extrusion orifices comprised a diameter of approximately 0.6 mm and a length to diameter ratio of approximately 7:1. An air-supply device (air knife) was provided at the die face, for impinging high velocity air (in a converging fashion) on the molten filaments essentially immediately after the molten filaments exited the orifices of the meltblowing die (e.g., within 1 cm of the die face). For nonwoven webs that included staple fibers, an apparatus of generally similar type to that disclosed by Hauser (U.S. Pat. No. 4,118,531) was used to inject an airborne stream of staple fibers into the airborne stream of meltblown blended-polymer fibers. The fibers (whether or not staple fibers were present) were collected on a collector.

WORKING EXAMPLES WITH STAPLE FIBERS

Representative Working Example 1

A nonwoven fibrous web comprising meltblown blended-polymer fibers and staple fibers was made using the above-described apparatus and general method, operated as described below. The apparatus included equipment for injecting staple fibers into the airborne stream of meltblown fibers. The poly(ethylene terephthalate) that was used in meltblowing was a 0.58 intrinsic viscosity PET resin obtained from Indorama under the trade designation RAMAPET L1. The poly(butylene terephthalate) (PBT) that was used in meltblowing was obtained from Sabic under the trade designation VALOX 195-1001. The staple fibers that were used were PET fibers (6 Denier, 40 mm length), obtained from XDL (China) under the trade designation 942D. The PBT and PET resins were injected into the extruder at an approximately 50:50 weight ratio. The die temperature was held at approximately 320° C. The nominal set-point of the high-velocity impinging air was approximately 400° C. The impinging air was delivered at a rate of approximately 220 Standard Cubic Feet Per Minute (SCFM), at an air knife gap of approximately 1.5 mm and a total working width of 508 mm (the width of the air knife thus extended beyond the width of the row of melt-blowing orifices, at both ends of the row of orifices, to enable a uniform exposure of all meltblown filaments to a similar airflow). The estimated linear velocity of the air was in the range of 8175 meters per minute. The thus-formed fibers were collected on an air-permeable belt at a DCD (die-to-collector distance) of approximately 24 cm. Process conditions were adjusted so that the webs within any given series (e.g., a series without staple fibers, or a series with staple fibers) were of at least generally similar solidity/loft.

The meltblowing apparatus was operated for a length of time to provide a meltblown web of basis weight in the range of approximately 200 grams per square meter. Then, the staple-fiber-injection apparatus was activated to begin injecting the PET staple fibers, which resulted, after the attaining of at least quasi-steady-state conditions, in a total web basis weight (meltblown fibers plus staple fibers) in the range of about 300 grams per square meter. The weight % staple fibers (of the total fibrous material of the web) was thus approximately 33%. The thermal shrinkage data for the resulting web are provided in Table 1.

Working Example 1a

A web comprising meltblown blended-polymer fibers and staple fibers was made in generally similar manner as in Working Example 1, except that the nominal set-point of the high-velocity impinging air was 350° C., the die temperature was 305° C., and the impinging air was delivered at a rate of approximately 208 SCFM. The weight % staple fibers in the web was approximately 40%. The thermal shrinkage data for the resulting web are provided in Table 1.

Working Example 2

A web comprising meltblown blended-polymer fibers and staple fibers was made in generally similar manner as in Working Example 1, except that PBT and PET resins were used at a 65:35 weight ratio (the nominal set-point of the high-velocity impinging air was 400° C., delivered at approximately 220 SCFM; die temperature was 310° C.). The weight % staple fibers in the web was approximately 34%. The thermal shrinkage data for the resulting web are provided in Table 1.

Working Example 2a

A web comprising meltblown blended-polymer fibers and staple fibers was made in generally similar manner as in Working Example 2 (PBT:PET ratio of 65:35), except that the nominal set-point of the high-velocity impinging air was 350° C., delivered at approximately 204 SCFM; the die temperature was 305° C. The weight % staple fibers in the web was approximately 42%. The thermal shrinkage data for the resulting web are provided in Table 1.

Working Example 3

A web comprising meltblown blended-polymer fibers and staple fibers was made in generally similar manner as in Working Example 1, except that PBT and PET resins were used at a 35:65 weight ratio (the nominal set-point of the high-velocity impinging air was 400° C., delivered at approximately 221 SCFM; die temperature was 335° C.). The weight % staple fibers in the web was approximately 33%. The thermal shrinkage data for the resulting web are provided in Table 1.

Working Example 3a

A web comprising meltblown blended-polymer fibers and staple fibers was made in generally similar manner as in Working Example 3 (PBT:PET ratio of 35:65), except that the nominal set-point of the high-velocity impinging air was 350° C., delivered at approximately 206 SCFM; the die temperature was 315° C. The weight % staple fibers in the web was approximately 42%. The thermal shrinkage data for the resulting web are provided in Table 1.

Comparative Example with Staple Fibers

Comparative Example 1

A nonwoven fibrous web comprising meltblown blended-polymer fibers and staple fibers was made in generally similar manner as in Working Example 1, except that 100 wt. % PBT resin was used (no PET resin) to make the meltblown fibers. The nominal set-point of the high-velocity impinging air was 340° C., delivered at approximately 200 SCFM; the die temperature was approximately 300° C. The weight % staple fibers in the web was approximately 38%. The thermal shrinkage data for the resulting web are provided in Table 1.

Comparative Example 2

A nonwoven fibrous web comprising meltblown blended-polymer fibers and staple fibers was made in generally similar manner as in Working Example 1, except that 100 wt. % PET resin was used (no PBT resin) to make the meltblown fibers. The nominal set-point of the high-velocity impinging air was 350° C., delivered at approximately 220 SCFM; the die temperature was approximately 330° C. The weight % staple fibers in the web was approximately 34%. The thermal shrinkage data for the resulting web are provided in Table 1.

The thermal shrink for the various samples is reported in Table 1.

TABLE 1

| Sample | Meltblown Fiber Composition | Blowing air Set Point | % Staple Fibers | Thermal Shrink, % |
|---|---|---|---|---|
| Working Ex. 1 | 50:50 PBT:PET | 400° C. | 33 | ~5 |
| Working Ex. 1a | 50:50 PBT:PET | 350° C. | 40 | ~5 |
| Working Ex. 2 | 65:35 PBT:PET | 400° C. | 34 | ~5 |
| Working Ex. 2a | 65:35 PBT:PET | 350° C. | 42 | ~5 |
| Working Ex. 3 | 35:65 PBT:PET | 400° C. | 33 | ~5 |
| Working Ex. 3a | 35:65 PBT:PET | 350° C. | 42 | ~8 |
| Comparative Ex. 1 | 100 PBT | 350° C. | 38 | ~4 |
| Comparative Ex. 2 | 100 PET | 350° C. | 34 | ~18 |

Examples without Staple Fibers

Example 4

A nonwoven fibrous web comprising meltblown blended-polymer fibers without staple fibers was made using the above-described apparatus (without using any equipment for injecting staple fibers) and general method, operated as described below. The poly(ethylene terephthalate) that was used was a 0.58 intrinsic viscosity PET resin obtained from Indorama under the trade designation RAMAPET L1. The poly(butylene terephthalate) (PBT) that was used was obtained from Ticona under the trade designation CELANEX. The PBT and PET resins were injected into the extruder at a 50:50 weight ratio. The die temperature was held at approximately 320° C.; the nominal set-point of the high-velocity impinging air was 400° C. The impinging air was delivered at a rate of approximately 220 Standard Cubic Feet Per Minute (SCFM); the estimated linear velocity of the air was in the range of 8200 meters per minute.

Example 4a

A nonwoven fibrous web comprising meltblown blended-polymer fibers was made in generally similar manner as in Example 4, except that the nominal set-point of the high-velocity impinging air was 340° C. The impinging air was delivered at a rate of approximately 208 Standard Cubic Feet Per Minute (SCFM); the estimated linear velocity of the air was in the range of 7700 meters per minute.

The thermal shrinkage data for the resulting web are provided in Table 2.

Example 5

A nonwoven fibrous web comprising meltblown blended-polymer fibers was made in generally similar manner as in Example 4, except that PBT and PET resins were used at a 65:35 weight ratio (the nominal set-point of the high-velocity impinging air was 400° C.; die temperature was 310° C.). The thermal shrinkage data for the resulting web are provided in Table 2.

Example 5a

A nonwoven fibrous web comprising meltblown blended-polymer fibers was made in generally similar manner as in Example 5, except that the nominal set-point of the high-velocity impinging air was 340° C. The thermal shrinkage data for the resulting web are provided in Table 2.

Comparative Example 3

A nonwoven fibrous web comprising meltblown blended-polymer fibers was made in generally similar manner as in Example 4, except that PBT and PET resins were used at a 35:65 weight ratio (the nominal set-point of the high-velocity impinging air was 400° C.; die temperature was 335° C.). The thermal shrinkage data for the resulting web are provided in Table 2.

Comparative Example 3a

A nonwoven fibrous web comprising meltblown blended-polymer fibers was made in generally similar manner as in Comparative Example 2, except that the nominal set-point of the high-velocity impinging air was 340° C. and the die temperature was 330° C. The thermal shrinkage data for the resulting web are provided in Table 2.

Comparative Example 4

A web comprising meltblown blended-polymer fibers was made in generally similar manner as in Comparative Example 3a, except that only PET (no PBT) resin was used. The nominal set-point of the high-velocity impinging air was 340° C. and the die temperature was 340° C. The thermal shrinkage data for the resulting web are provided in Table 2.

Comparative Example 5

A web comprising meltblown blended-polymer fibers was made in generally similar manner as in Comparative Example 3a, except that only PBT (no PET) resin was used. The nominal set-point of the high-velocity impinging air was 340° C. and the die temperature was 300° C. The thermal shrinkage data for the resulting web are provided in Table 2.

The thermal shrink for the various samples is reported in Table 2.

TABLE 2

| Sample | Meltblown Fiber Composition | Blowing air Set Point | Thermal Shrink, % |
|---|---|---|---|
| 4 | 50:50 PBT:PET | 400° C. | ~4 |
| 4a | 50:50 PBT:PET | 350° C. | ~6 |

TABLE 2-continued

| Sample | Meltblown Fiber Composition | Blowing air Set Point | Thermal Shrink, % |
|---|---|---|---|
| 5 | 65:35 PBT:PET | 400° C. | ~4 |
| 5a | 65:35 PBT:PET | 350° C. | ~6 |
| Comparative Ex. 3 | 35:65 PBT:PET | 400° C. | ~24 |
| Comparative Ex. 3a | 35:65 PBT:PET | 350° C. | ~29 |
| Comparative Ex. 4 | 100 PET | 340° C. | ~38 |
| Comparative Ex. 5 | 100 PBT | 350° C. | ~7 |

The foregoing Examples are provided according to available records and have been provided for clarity of understanding only; no unnecessary limitations are to be understood therefrom. The tests and test results described in the Examples are intended to be illustrative rather than predictive, and variations in the testing procedure can be expected to yield different results. All quantitative values in the Examples are understood to be approximate in view of the commonly known tolerances involved in the procedures used.

It will be apparent to those skilled in the art that the specific exemplary elements, structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof). Although various theories and possible mechanisms may have been discussed herein, in no event should such discussions serve to limit the claimable subject matter. To the extent that there is any conflict or discrepancy between this specification as written and the disclosure in any document incorporated by reference herein, this specification as written will control.

What is claimed is:

1. A thermally stable nonwoven web, comprising:

meltblown fibers, wherein at least selected meltblown fibers are blended-polymer fibers each comprising a blend of poly (butylene terephthalate) (PBT) and poly(ethylene terephthalate) (PET), wherein the PET is substantially free of non-polymeric nucleating agent and wherein the meltblown fibers exhibit an average weight ratio of PBT to PET of from about 80:20 to about 30:70;

and, staple fibers, wherein the staple fibers make up from about 10 wt. % to about 60 wt. % of the total weight of the fibrous material of the web;

and wherein the thermally stable nonwoven web exhibits a thermal shrink of less than about 10%.

2. The web of claim 1, wherein the meltblown fibers exhibit an average weight ratio of PBT to PET of from about 70:30 to about 35:65.

3. The web of claim 1, wherein the meltblown fibers collectively exhibit an average fiber diameter of less than about 10 micrometers.

4. The web of claim 1, wherein the staple fibers make up from about 20 wt. % to about 60 wt. % of the total weight of the fibrous material of the web.

5. The web of claim 1, wherein the staple fibers make up from about 30 wt. % to about 60 wt. % of the total weight of the fibrous material of the web.

6. The web of claim 1, wherein the staple fibers make up from about 40 wt. % to about 60 wt. % of the total weight of the fibrous material of the web.

7. The web of claim 1, wherein the staple fibers are PET fibers.

8. The web of claim 1, wherein the web exhibits a thermal shrink of less than about 6%.

9. The web of claim 1, wherein the web exhibits a thermal shrink of less than about 4%.

10. The web of claim 1, wherein the web exhibits a thermal shrink of less than about 2%.

11. The web of claim 1, wherein the meltblown fibers collectively comprise no more than about 5 wt. % of any polymeric material that exhibits a $T_m$ of less than 200° C.

12. The web of claim 1, wherein the meltblown fibers are substantially free of any polymeric material with a $T_m$ of less than 200° C.

13. An article comprising the thermally stable nonwoven web of claim 1, wherein the article is selected from the group consisting of a thermal insulation article, an acoustic insulation article, a fluid filtration article, or a combination thereof.

14. The article of claim 13, wherein the article is an acoustic insulation article that exhibits a thermal shrink of less than about 5%.

* * * * *